United States Patent [19]

Brandolino

[11] 4,023,461

[45] May 17, 1977

[54] BASS DRUM BEATER

[76] Inventor: Sandro A. Brandolino, 1801 Lincoln Ave., Joliet, Ill. 60435

[22] Filed: Sept. 10, 1975

[21] Appl. No.: 611,900

[52] U.S. Cl. ..... 84/422 S

[51] Int. Cl.[2] ..... G10D 13/00

[58] Field of Search ..... 84/422, 104

[56] References Cited

UNITED STATES PATENTS

| | | | |
|---|---|---|---|
| 965,435 | 7/1910 | Brauer | 84/422 |
| 1,343,164 | 6/1920 | Smith | 84/422 |
| 3,316,792 | 5/1967 | Ippolito | 84/422 |

FOREIGN PATENTS OR APPLICATIONS

| | | | |
|---|---|---|---|
| 416,113 | 11/1946 | Italy | 84/422 |
| 262,194 | 12/1926 | United Kingdom | 84/422 |

*Primary Examiner*—Stephen J. Tomsky
*Attorney, Agent, or Firm*—Clarence A. O'Brien; Harvey B. Jacobson

[57] ABSTRACT

An elongated bar is provided and one end of the bar includes structure for removable support from an oscillatable hammer block of a pedal actuating assembly with the other end of the bar projecting outwardly from the block generally radially of its axis of oscillation. The other end of the bar includes an outer terminal end portion including a first threaded connection structure and a beater ball is provided and includes a second threaded connection structure. The first and second threaded connector structures coact to removably threadedly support the beater ball from the outer terminal end portion of the bar. The beater ball is supported from the bar spaced outwardly of one side thereof to be advanced toward a bass drum and the structure comprising the first and second threaded connector structure is of simple design for ease in manufacture at a low cost and also capable of establishing a firm but releasable connection between the beater ball and the bar.

4 Claims, 5 Drawing Figures

BASS DRUM BEATER

BACKGROUND OF THE INVENTION

Various forms of drum beaters have been heretofore designed, but most have not been constructed in a manner whereby a beater ball may be firmly but removably supported from the associated end of its elongated support bar through the utilization of relatively simple structural features which may be mass produced at a low cost. Examples of previously known drum beater constructions are disclosed in U.S. Pat. Nos. 1,209,804, 1,496,456, 2,586,163, 2,800,828, 3,151,518 and 3,316,792.

BRIEF DESCRIPTION OF THE INVENTION

The drum beater of the instant invention includes an elongated bar portion, as usually provided, and one end of the bar portion is constructed for removable support from an oscillatable hammer block of a foot actuator assembly. The other end of the bar securely removably supports a laterally offset beater ball or element in a manner with the beater ball or element facing away from the bar.

The removable connection between the beater ball and the free end of the associated bar comprises a threaded connection established by readily available and manufactured components and the drum beater is therefore capable of being produced at a low cost.

The main object of this invention is to provide a drum beater capable of securely, but removably supporting a beater ball from the associated support bar therefor.

Another object of this invention, in accordance with the immediately preceding object, is to provide a drum beater including an elongated support bar portion of sufficient length to enable the drum beater to be utilized on large bass drums and still enable the beater ball portion thereof to be engaged with the central portion of the drum.

A further important object of this invention is to provide a drum beater comprising only three components and with two of the components permanently bonded together.

Still another object of this invention is to provide a drum beater including a beater ball supported from an associated elongated support bar in a manner such that the ball is firmly supported from the bar against accidental dislodgement therefrom, but enabling the ball to be removed and replaced by another ball of similar construction.

A final object of this invention to be specifically enumerated herein is to provide a drum beater in accordance with the preceding objects and which will conform to conventional forms of manufacture, be of simple construction and easy to use to as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
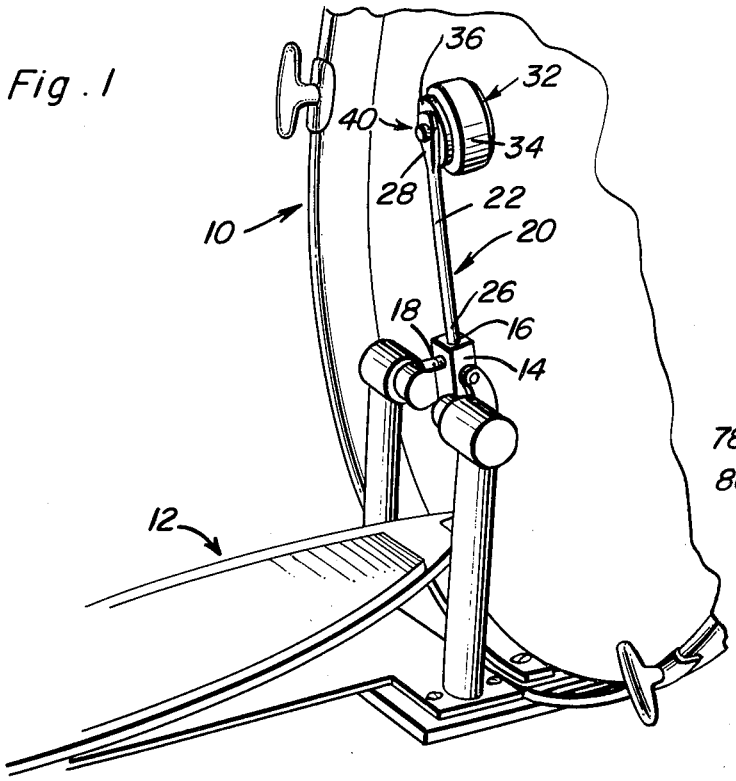
FIG. 1 is a fragmentary perspective view of a base drum having a drum beater foot actuated mechanism operatively associated therewith and with the drum beater assembly of the instant invention operatively associated therewith.

Referring now more specifically to the drawings, the numeral 10 generally designates a large bass drum having a foot actuator assembly referred to in general by the reference numeral 12 for a drum beater operatively associated therewith. The foot actuator assembly 12 is of conventional design and includes an oscillatable hammer block 14 having a bore 16 formed therein with which a setscrew 18 is operatively associated.

A first form of drum beater constructed in accordance with the present invention is referred to in general by the reference numeral 20 and includes an elongated bar 22 provided with a first cylindrical end portion 26 removably telescoped in the bore 16 and releasably retained within the bore 16 by means of the setscrew 18. The opposite end portion 28 of the bar is transversely flattened and has a threaded bore 30 formed centrally therethrough.

The drum beater 20 further includes a beater ball or element referred to in general by the reference numeral 32 and the element 32 is in the form of a solid cylindrical body 34 including a diametrically reduced base end portion 36. The body 34 has the head 38 and the adjacent portion of the shank 39 of a bolt referred to in general by the reference numeral 40 embedded therein and the shank 39 projects centrally outwardly from the base end portion 36 and is threadedly engaged in the threaded bore 30 so as to removably threadedly supported the beater ball or element 32 from the bar 22.

Figure 4:
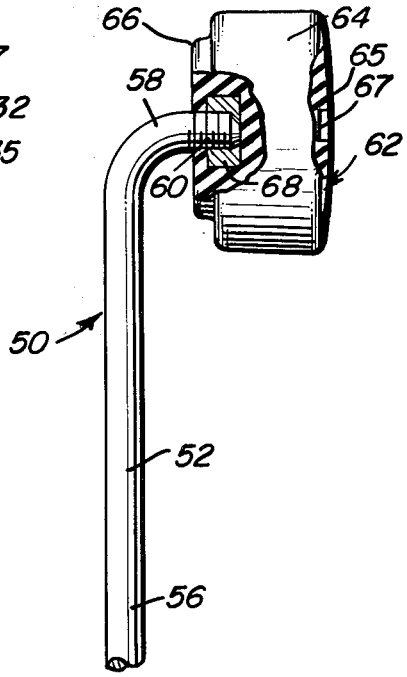
FIG. 4 is a side elevational view of a modified form of drum beater with portions of the drum beater ball being broken away and illustrated in vertical section.

Referring now more specifically to FIG. 4 of the drawings there will be seen a second form of drum beater referred to in general by the reference numeral 50. The beater 50 includes an elongated bar 52 having a first end portion 56 corresponding to the end portion 26 and a second right angularly bent end portion 58 which is externally threaded as at 60. The drum beater 50 includes a beater ball or element referred to in general by the reference numeral 62 and the beater element 62 comprises a cylindrical body 64 having a diametrically reduced base end portion 66 corresponding to the base end portion 36. However, the rear central portion of the body 64 has a threaded castellated nut 68 embedded therein and one end of the nut 68 opens outwardly through the central portion of the base end portion 66 of the body 64. The threaded end portion 58 is removably threadedly engaged in the nut 68 and the beater element 62 is therefore removably threadedly supported from the bar 52.

Figure 5:
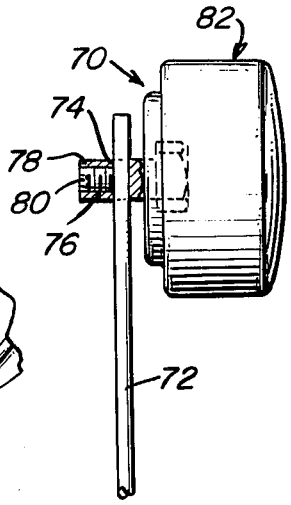
FIG. 5 is a side elevational view of a second modified form of drum beater.
Figure 2:
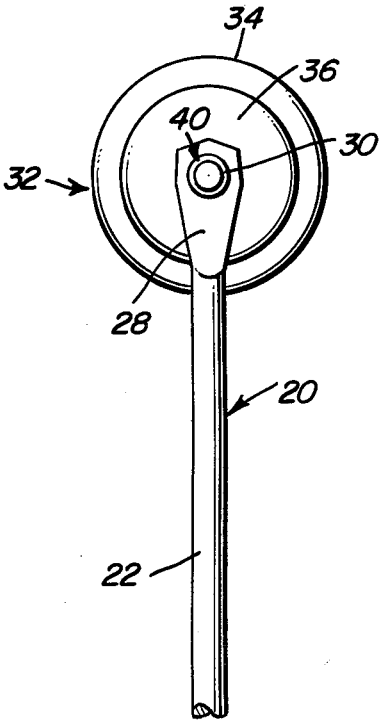
FIG. 2 is a fragmentary face elevational view of the outer side of a first form of drum beater constructed in accordance with the present invention.
Figure 3:
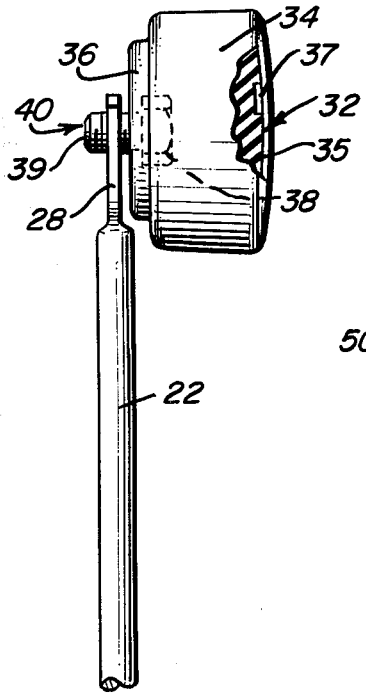
FIG. 3 is a side elevational view of the assemblage illustrated in FIG. 2 as seen from the right side thereof.

FIG. 5 represents a third form of drum beater referred to in general by the reference numeral 70 which is similar to the beater 20, but whose shank 72 is slidably received through a diametric bore 74 formed in the smooth shank 76 corresponding to shank 39. Further, the free end of shank 76 inludes a threaded axial bore 78 opening into bore 74 and in which a threaded set screw 80 is received for releasably locking the beater element 82 corresponding to element 32 in adjusted position along shank 72.

It will be noted that the bodies 34 and 64 are supported from the free ends of the bars 22 and 52 spaced outwardly of corresponding sides of the bars and that the bodies 34 and 64 may be readily removed and replaced by other bodies (now shown). Further, the bodies 34 and 64 may be of any suitable material such as rubber or plastic and it is to be further noted that the rubber or plastic may be considered as soft, hard or of medium hardness as desired by the user of the drum beaters. Further, the striking faces 35 and 65 of the bodies 34 and 64 are slightly convex spherical and include indented indicia 37 and 67 in order to reduce any tendency of the faces 36 and 65 to stick to the head of the associated drum. The indented indicia 37 and 67 may each comprise a series of predetermined letters forming a word such as"Bomber". Still further, it is to be noted that the length of the bars 22 and 52 will be between eight and nine inches, whereby the bars will be of sufficient length to position the elements 32 and 62 at the approximate center of the head of an associated large diameter bass drum.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A drum beater comprising an elongated bar, one end of said bar being adapted to be removably anchored to an oscillatable hammer block with the other end of said bar projecting outwardly from said block generally radially of its axis of oscillation, the other end of said bar including a terminal end portion, a beater ball, means removably supporting said beater ball from said terminal end portion with said beater ball disposed to one side of said bar, the side of said beater ball remote from said bar being slightly convex spherical and including central portions thereof having shallow recesses formed therein, said means removably supporting said beater ball from said terminal end portion including a threaded connection between said ball and bar defining a central thread axis extending centrally through said ball and at generally right angles to the longitudinal extent of said bar.

2. The combination of claim 1 wherein said teminal end portion includes first threaded connecting means and said beater ball includes second threaded connecting means, said first and second threaded connecting means coacting to threadedly support said beater ball from said terminal end portion and defining said threaded connection.

3. The combination of claim 1 wherein said terminal end portion comprises a transversely flattened end portion, a threaded bore formed through said flattened end protion, and a threaded shank portion projecting outwardly of one side of said beater ball and threadedly engaged in said bore defining said threaded connection.

4. The combination of claim 2 wherein said terminal end portion comprises a right angular shank portion, said first threaded connecting means comprising threads formed on said shank portion, said second threaded connecting means comprising a threaded bore defined in an opening outwardly of one side of said beater ball in which said threaded shank portion is threadedly engaged to define said threaded connection.

* * * * *